US005682606A

United States Patent [19]

Pospisil

[11] Patent Number: 5,682,606

[45] Date of Patent: Nov. 4, 1997

[54] SUN MASK

[76] Inventor: Lisa Pospisil, 55 E. 93rd St., Apt. 2-C, New York, N.Y. 10128

[21] Appl. No.: 583,775

[22] Filed: Jan. 11, 1996

[51] Int. Cl.[6] ..... A41D 13/00; A61F 9/04

[52] U.S. Cl. ..... 2/9; 2/6.4; 2/6.5; 2/173

[58] Field of Search ..... 2/424, 9, 6.4, 6.5, 2/10, 13, 15, 12, 427, 429, 430, 431, 173

[56] References Cited

U.S. PATENT DOCUMENTS

| | | | |
|---|---|---|---|
| 1,911,817 | 5/1933 | Du Bois . | |
| 2,774,970 | 12/1956 | DuBois | 2/9 |
| 3,114,914 | 12/1963 | Ruggiero . | |
| 3,295,143 | 1/1967 | Hoffman . | |
| 3,651,847 | 3/1972 | Casamassima . | |
| 3,686,690 | 8/1972 | Webb . | |
| 3,943,574 | 3/1976 | Yamaguchi et al. | 2/9 |
| 4,364,123 | 12/1982 | Sam . | |
| 4,821,340 | 4/1989 | Johnson . | |
| 4,843,643 | 7/1989 | Parissenti et al. . | |
| 4,856,109 | 8/1989 | Desy et al. . | |
| 4,924,526 | 5/1990 | Parissenti et al. . | |
| 4,944,039 | 7/1990 | Dietrich . | |
| 4,945,573 | 8/1990 | Landis . | |
| 4,955,394 | 9/1990 | Dean . | |
| 4,965,887 | 10/1990 | Paoluccio et al. . | |
| 5,012,527 | 5/1991 | Michel | 2/9 |
| 5,206,956 | 5/1993 | Olson . | |
| 5,220,689 | 6/1993 | Miller | 2/427 |
| 5,245,709 | 9/1993 | Slipcott | 2/9 |
| 5,247,706 | 9/1993 | Mark | 2/9 |
| 5,297,298 | 3/1994 | Salatka et al. | 2/9 |

*Primary Examiner*—C. D. Crowder
*Assistant Examiner*—Larry D. Worrell, Jr.
*Attorney, Agent, or Firm*—Brumbaugh, Graves, Donohue & Raymond

[57] ABSTRACT

The present invention relates to a curved, self-supporting mask which may be worn to protect the wearer from unwanted exposure to the sun and wind. The mask includes a shield fabricated of material which blocks the penetration of ultraviolet radiation.

12 Claims, 15 Drawing Sheets

SUN MASK

1. INTRODUCTION

The present invention relates to a curved, self-supporting mask which may be worn to protect the wearer from unwanted exposure to the sun and wind. The mask includes a transparent shield fabricated of material which blocks the penetration of ultraviolet radiation.

2. BACKGROUND OF THE INVENTION

The public has become increasingly aware of the potentially adverse effects of sun exposure. Damage to the skin by ultraviolet radiation has been associated with premature aging and the development of skin cancers. Accordingly, there is a need for products that protect individuals from ultraviolet rays in sunlight. Such products would desirably be comfortable to use and attractive to wear.

Protection of the face from unwanted exposure to the sun may be problematic. Unlike other parts of the body, the face is not, typically, covered by clothing. Chemical sunscreens may prove irritating to the skin and eyes. In imperfect attempts at solving this problem, it is not uncommon to see sunbathers who have covered their faces with a hat, towel, or tee shirt—methods which impair breathing, promote perspiration, and create a relatively unattractive appearance.

Various devices have been designed to afford protection to a wearer's face from environmental agents or other hazards (e.g., flying particles, splattering chemicals). These include face shields which comprise means for attachment directly to the head of the wearer (e.g., as disclosed in U.S. Pat. No. 1,911,817 by Du Bois; U.S. Pat. No. 2,774,970 by Du Bois; U.S. Pat. No. 3,114,914 by Ruggiero; U.S. Pat. No. 3,295,143 by Hoffman; U.S. Pat. No. 3,686,690 by Webb and U.S. Pat. No. 4,856,109 by Desy et al.), and shields that may be attached to the wearer's eyeglasses (e.g., as disclosed in U.S. Pat. No. 4,821,340 by Johnson; U.S. Pat. No. 4,843,643 by Parissenti et al.; U.S. Pat. No. 4,924,526 by Parissenti et al.; U.S. Pat. No. 4,944,039 by Dietrich, U.S. Pat. No. 4,945,573 by Landis; U.S. Pat. No. 4,955,394 by Dean; U.S. Pat. No. 4,965,887 by Paoluccio et al.; U.S. Pat. No. 5,206,956 by Olson; and U.S. Pat. No. 5,247,706 by Mark). Devices which may serve as both a sunshield and a beachbag are also disclosed (e.g., as disclosed in U.S. Pat. No. 3,651,847 by Casamassima and U.S. Pat. No. 4,364,123 by Sam).

None of the devices disclosed in the prior art, however, provide for a mask, according to the invention, which (i) protects the entire face, front and sides, of the wearer from ultraviolet radiation from the sun and from wind; (ii) is attractive to wear, and, in various embodiments, is (iii) ventilated for air flow and comfort and/or (iv) is collapsible so as to allow easy portability and to permit the wearer to speak, eat and drink while wearing the mask.

3. SUMMARY OF THE INVENTION

The present invention relates to a mask, hereafter referred to as a "sunmask", which is comprised of a curved shield which may be positioned over the front and sides of the wearer's face, held in place by elements which maintain the shield at a comfortable distance from the wearer's face and/or which rest above the wearer's ears. The shield may be fabricated of a material which filters out ultraviolet radiation, and may be ventilated in a manner which avoids the passage of light onto the wearer's face. In particular embodiments of the invention, the shield may be collapsible.

In various embodiments, the support element may either (i) rest upon the bridge of the nose and extend across the forehead of the wearer when worn (see, for example, FIGS. 1–4 and 13); (ii) rest upon the bridge of the nose and extend across the cheeks of the wearer when worn (see, for example, FIGS. 5–8 and 14); or (iii) merely rest upon the bridge of the nose of the wearer (see, for example, FIGS. 9–12 and 15).

According to the invention, the shield is curved, so as to protect the wearer's face from sun and wind and, when the wearer reclines on a sandy beach, from blowing sand and debris. The shield may have any shape, including oval, circular, square, rectangular, heart-shaped, triangular, face-shaped, and so forth, provided that it affords protection to the face of the wearer preferably in an area extending from the chin to the hairline, and preferably also affords protection over at least a portion of the top of the wearer's head. It may be curved in one or more dimensions and have various three-dimensional shapes, and resemble a dome, or a knight's visor.

The shield may be transparent, translucent, or opaque, or may comprise transparent, translucent, and/or opaque regions in any combination or design. The shield, or one or more portions of the shield, may be colorless or tinted, and may be decorated with an artistic design.

The shield is fabricated of a material which blocks the penetration of ultraviolet light. The phrase "blocks the penetration of ultraviolet light" refers to an ability to filter out at least 75 percent and preferably more than 90 percent of ultraviolet A and/or ultraviolet B radiation. Examples of suitable materials include durable plastics; preferred embodiments include polycarbonate, polyvinyl chloride, acetate, polyester, acrylic and butyrate.

The thickness of the shield may vary depending upon the weight of the constituent material, but preferably ranges from 0.010–0.06.

In preferred, nonlimiting embodiments of the invention, the dimensions of the shield may preferably be 9½ inches in height and 13 inches in width.

In various embodiments of the invention, the shield may comprise a plurality of segments joined at one or more rotation axis pivot, for example joined by rivet-like pins. The segments may be rotated together, in a telescoping arrangement, to collapse the shield into a smaller volume which improves portability, or may be rotated apart so as to form a contiguous shield which may cover the face of the wearer. The shield may consist of two segments, as illustrated in FIGS. 1–12, or more than two segments. The rotation axis pivot(s) may be located at the sides of the shield (see, for example, FIGS. 1–12), at the top and/or bottom of the shield, at the center of the shield, or in any other appropriate position(s).

The shield may contain one or more venting perforations to aid in the circulation of air and to improve the comfort of the wearer. Such perforations are preferably slits cut through the material of the shield at an angle, to prevent the penetration of ultraviolet radiation through the perforations onto the face of the wearer.

The shield is attached to a support element which properly positions the shield over the face of the wearer. In various embodiments, the support element may comprise a nose rest element similar to that used in conventional eyeglasses (see FIGS. 9–12 and 15). The support element may further extend across the forehead of the wearer, for example, similar to the top part of the front piece of conventional eyeglasses (see FIGS. 1–4 and 13); alternatively, the support element may extend across the cheeks of the wearer (see FIGS. 5–8 and 14). The support element may be made of any suitable durable material, and may be formed in any design.

The sunmask further comprises anchoring elements which hold the sunmask in place on the wearer, resting above the wearer's ears. The anchoring elements may be connected to the support element; for example, in a manner similar to the temple bars of conventional eyeglasses (see FIGS. 1–4 and 13–15). Alternatively, the anchoring elements may be continuous with the shield (see FIGS. 5–12). The anchoring elements may be fabricated of any suitable durable material, and may be formed in any design.

4. BRIEF DESCRIPTION OF THE DRAWINGS

5. DETAILED DESCRIPTION OF THE INVENTION

The present invention relates to a sunmask comprising (i) a curved shield that is fabricated from a material which blocks the penetration of ultraviolet radiation and is shaped and dimensioned to overlie the front and sides of the face of a wearer when the sunmask is worn, (ii) a support means that is attached to the shield and is adapted to engage at least one selected region of the wearer's face for positioning the shield in a predetermined position spaced apart from and overlying the wearer's face, and (iii) anchoring means that is attached to the shield and is adapted to engage the wearer's head in regions above the ears for holding the sunmask in place.

In various nonlimiting embodiments, the present invention relates to a sunmask comprising (i) a curved shield that is fabricated from a material which blocks the penetration of ultraviolet radiation and is shaped and dimensioned to overlie the front and sides of the face of a wearer when the sunmask is worn, composed of a plurality of segments pivotally connected for movement about a pivot axis transverse to a wearer's head such that the segments may be moved between a position in which they overlie each other and overlie a only a portion of the wearer's face and a position in which they form a continuous shield which overlies the front and sides of the face of the wearer, (ii) support means that is attached to the shield and is adapted to engage at least one selected region of the wearer's face for positioning the shield in a predetermined position spaced apart from and overlying the wearer's face, and (iii) anchoring means that is attached to the shield and is adapted to engage the wearer's head in regions above the ears for holding the sunmask in place.

FIGS. 1–4 depict a collapsible sunmask having a segmented shield (1A) and having a support element (2A), attached to the shield at (10), which engages the bridge of the nose and extends across the forehead of the wearer, and an anchoring means (3A) which is connected to the support element and which rests above the wearer's ears. The shield (1A) is comprised of two segments, a top panel (4A) and a lower panel (5A), joined at a rotation axis pivot (6). The shield is ventilated by multiple slit perforations (7A).

Figure 1:
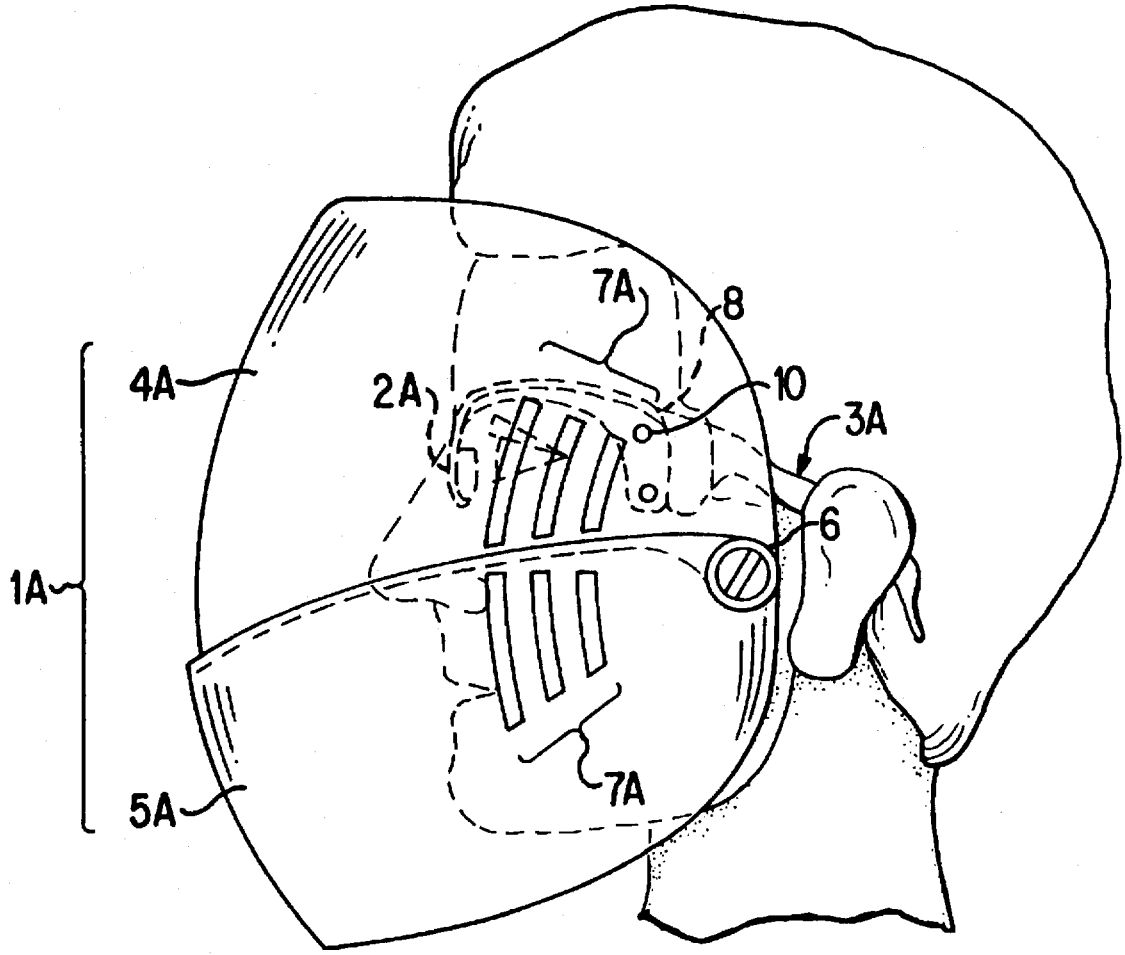
FIG. 1 is a side view of a collapsible sunmask having a shield with two segments, a top panel and a bottom panel, and having a support means which rests upon the bridge of the nose and across the forehead of the wearer.

FIG. 1 shows a side view of a collapsible sunmask having a segmented shield (1A), wherein the lower panel (5A) of the shield is rotated downward via the rotation axis pivot (6); note that the support means (2A) rests upon the bridge of the nose of the wearer and extends across the wearer's forehead, similar to the frontal piece of a conventional pair of eyeglasses. Ventilation slits (7A) are positioned at the sides of the shield to avoid the penetration of ultraviolet radiation onto the wearer's face. The support means (2A) is joined to the shield at (10). The anchoring means (3A) is connected (8) to the support means (2A) in a manner which resembles the joining of the frontal piece and the temple bars of conventional eyeglasses. The anchoring means (3A) engages the wearer's head above the ears.

Figure 2:
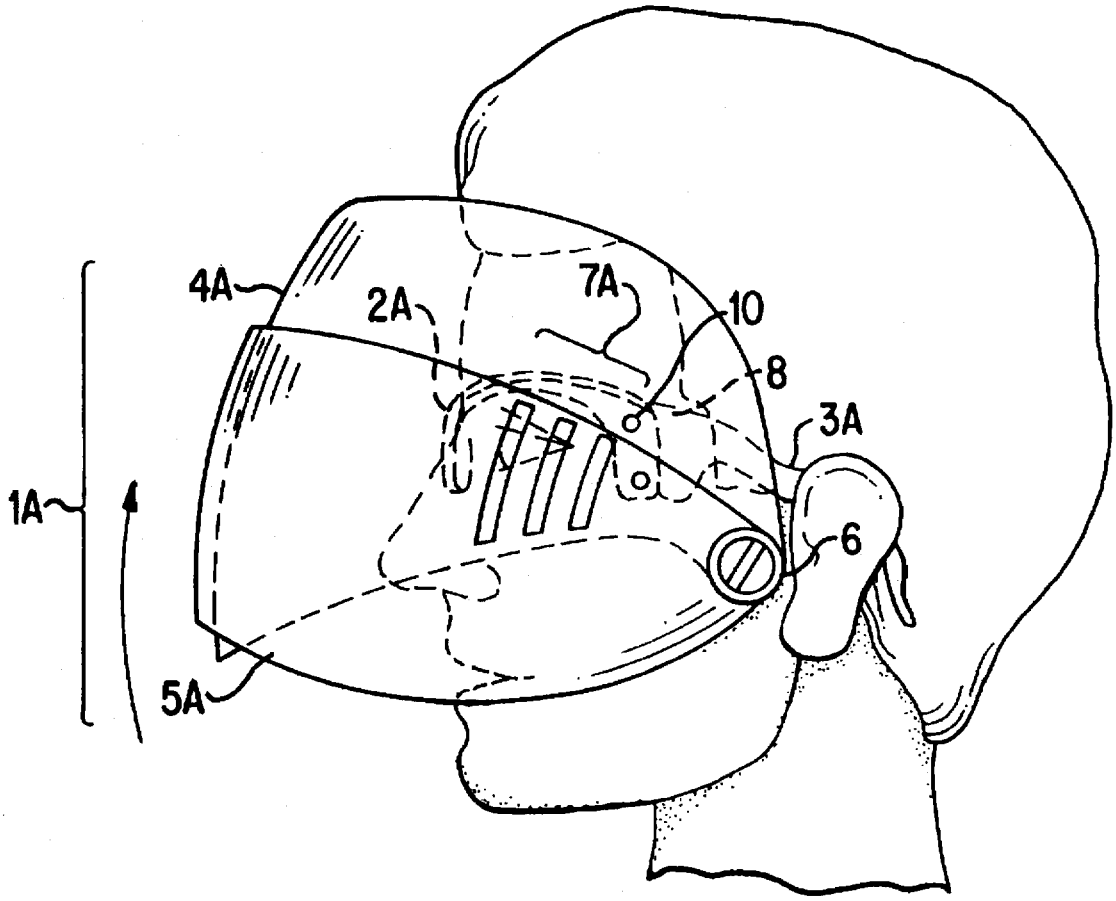
FIG. 2 is the collapsible sunmask of FIG. 1 with the lower panel rotated upward, to produce a collapsed conformation.

FIG. 2 shows a side view of the sunmask of FIG. 1 wherein the shield is in a collapsed conformation, with the lower panel (5A) of the shield in the up position to pass over and cover part of the top panel (4A).

Figure 3:
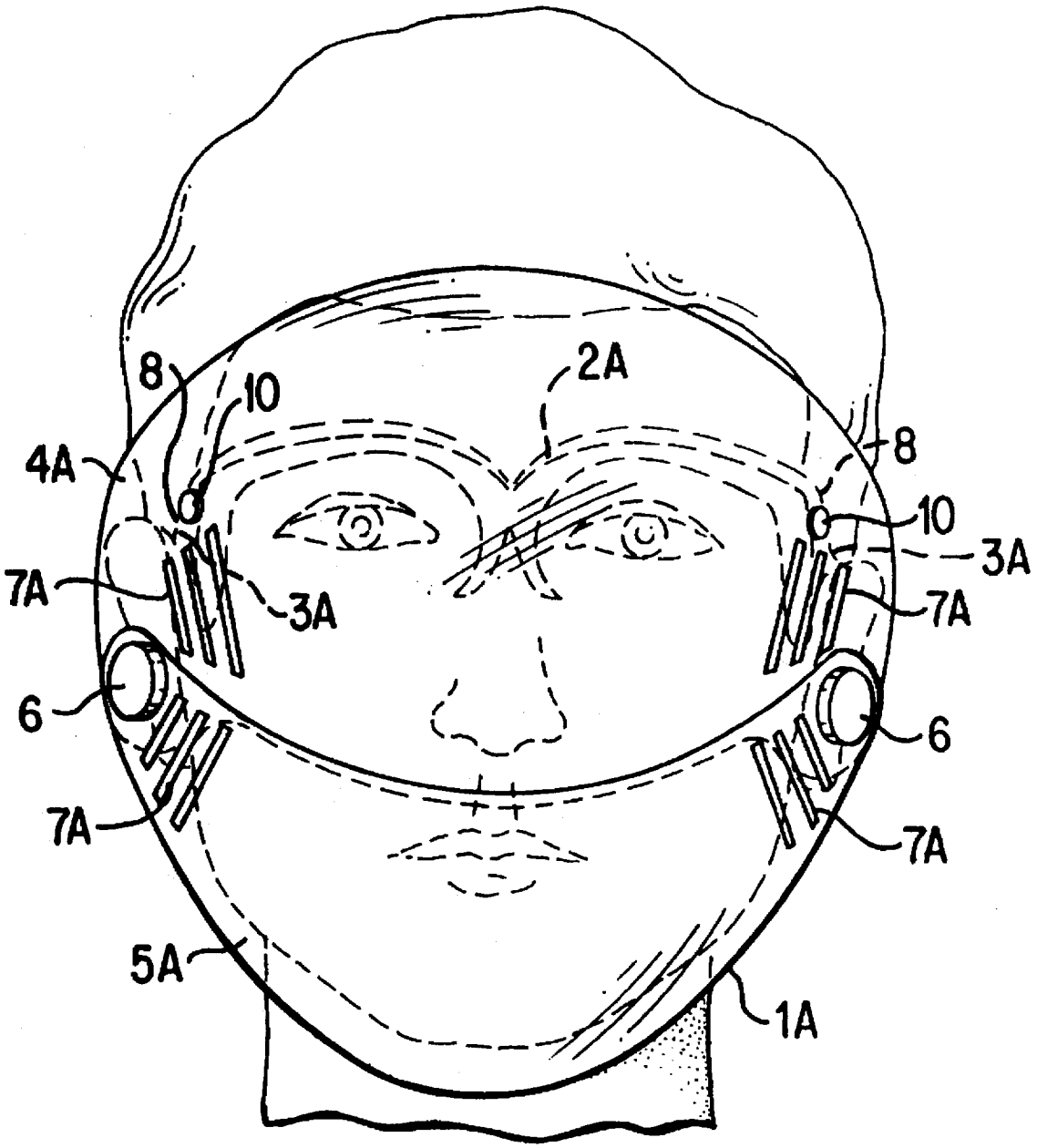
FIG. 3 is a frontal view of the collapsible sunmask of FIG. 1.

FIG. 3 shows a front view of the sunmask of FIG. 1, showing the support means (2A) to have, in this embodiment, a bifurcation which rests upon the bridge of the nose of the wearer, and to pass across the forehead of the wearer in proximity to the eyebrows.

Figure 4:
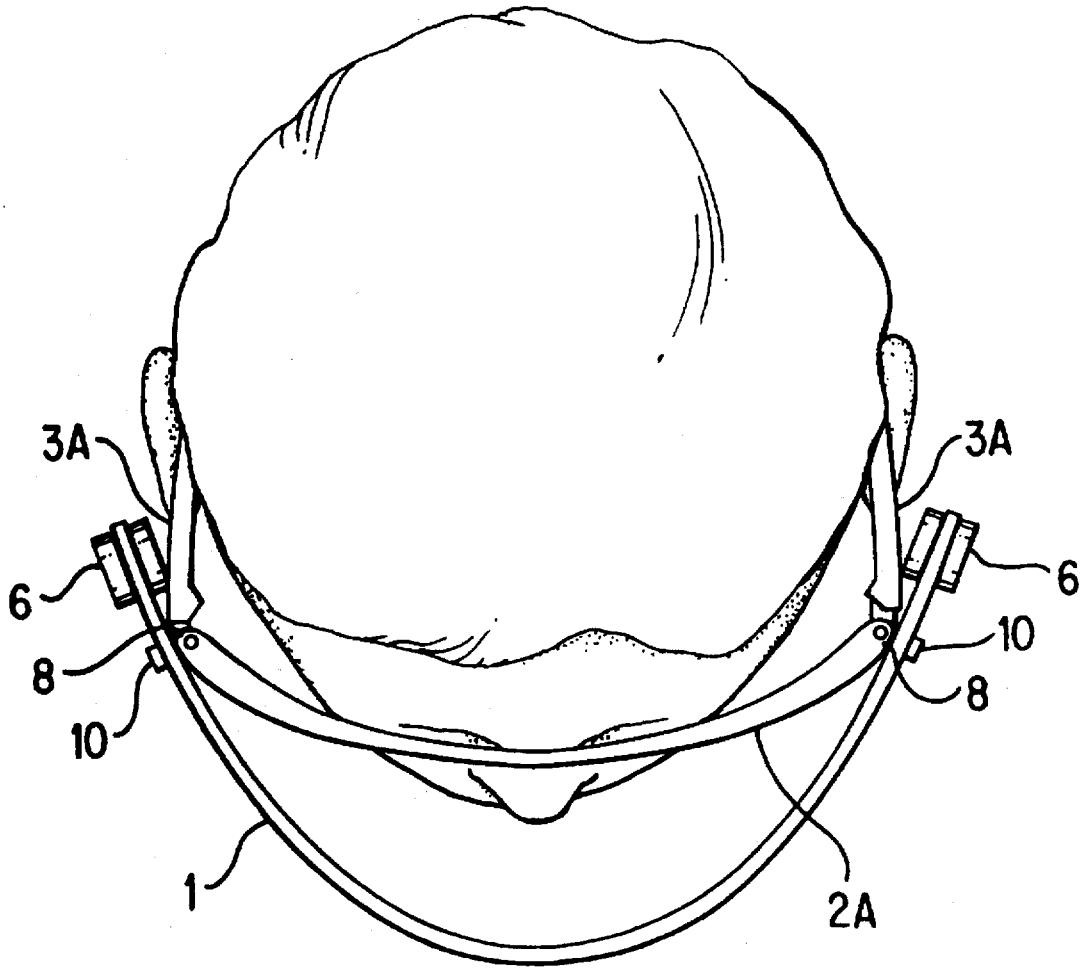
FIG. 4 is a top view of the collapsible sunmask of FIG. 1.

FIG. 4 shows a top view of the sunmask of FIG. 1, showing the point of attachment (8) between the support means (2A) and the anchoring means (3A), which is articulated in a manner similar to that used in conventional eyeglasses, as well as the point of attachment (10) of the support means (2A) and the shield (1A).

FIGS. 5–8 depict a collapsible sunmask having a segmented shield (1B) and having a support means (2B) which rests upon the bridge of the nose and across the cheeks of the wearer, and an anchoring means (3B) which is continuous with the top panel (4B) of the shield and engages the head of the wearer above the wearer's ears. The shield is comprised of two segments, a top panel (4B) and a lower panel (5B), joined at a rotation axis pivot (6). The shield is vented by multiple slit perforations (7B).

Figure 5:
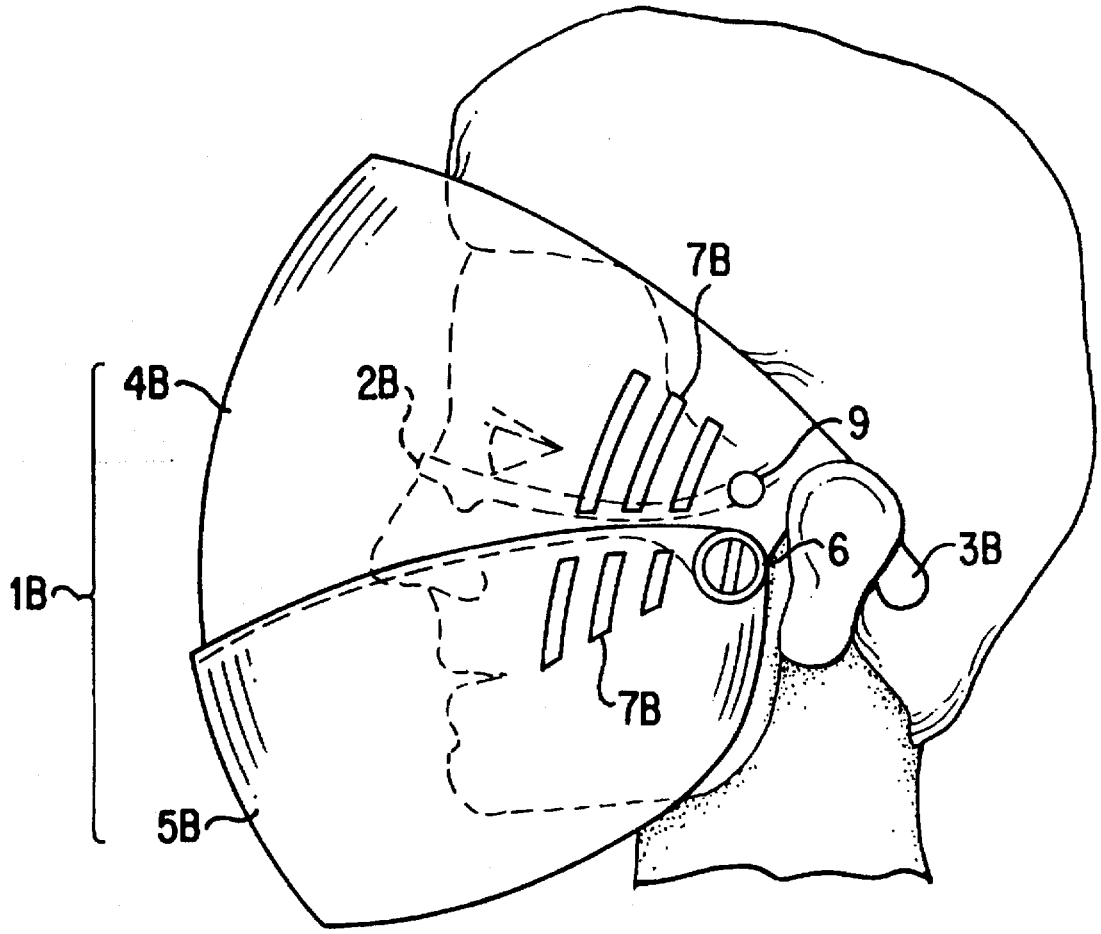
FIG. 5 is a side view of a collapsible sunmask having a shield in two segments, a top panel and a bottom panel, and having a support means which rests upon the bridge of the nose and across the cheeks of the wearer.

FIG. 5 shows a side view of a collapsible sunmask with the lower panel (5B) of the shield in down position. The support means (2B) engages the bridge of the wearer's nose and then passes across the cheeks and under the eyes of the wearer, and attaches to the shield at (9). The anchoring means (3B) is continuous with the top panel (4B) of the shield and is shaped to engage the wearer's head above the ears in a manner similar to conventional eyeglasses.

Figure 6:
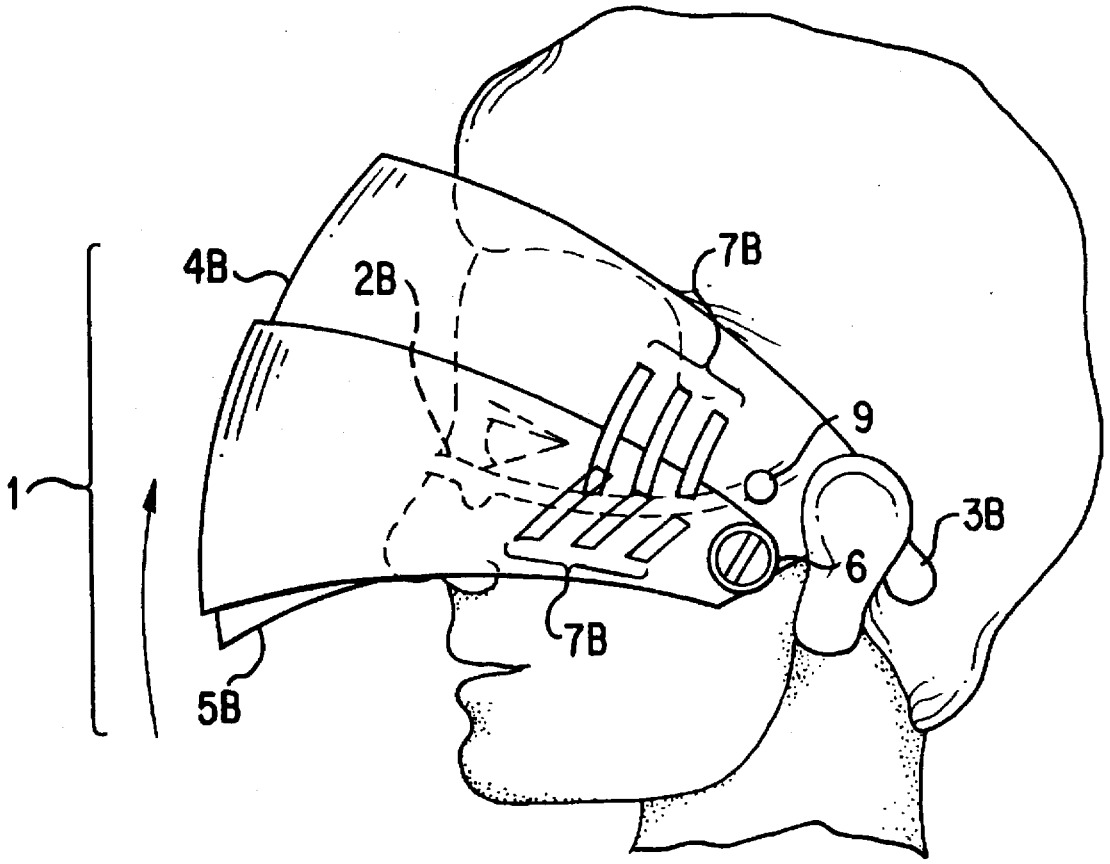
FIG. 6 is the collapsible sunmask of FIG. 5 with the lower panel rotated upward to produce a collapsed conformation.

FIG. 6 shows a side view of the sunmask of FIG. 5 wherein the shield is in collapsed conformation, with the lower panel (5B) of the shield in the up position, rotated over the top panel (4B) via the rotation axis pivot.

Figure 7:
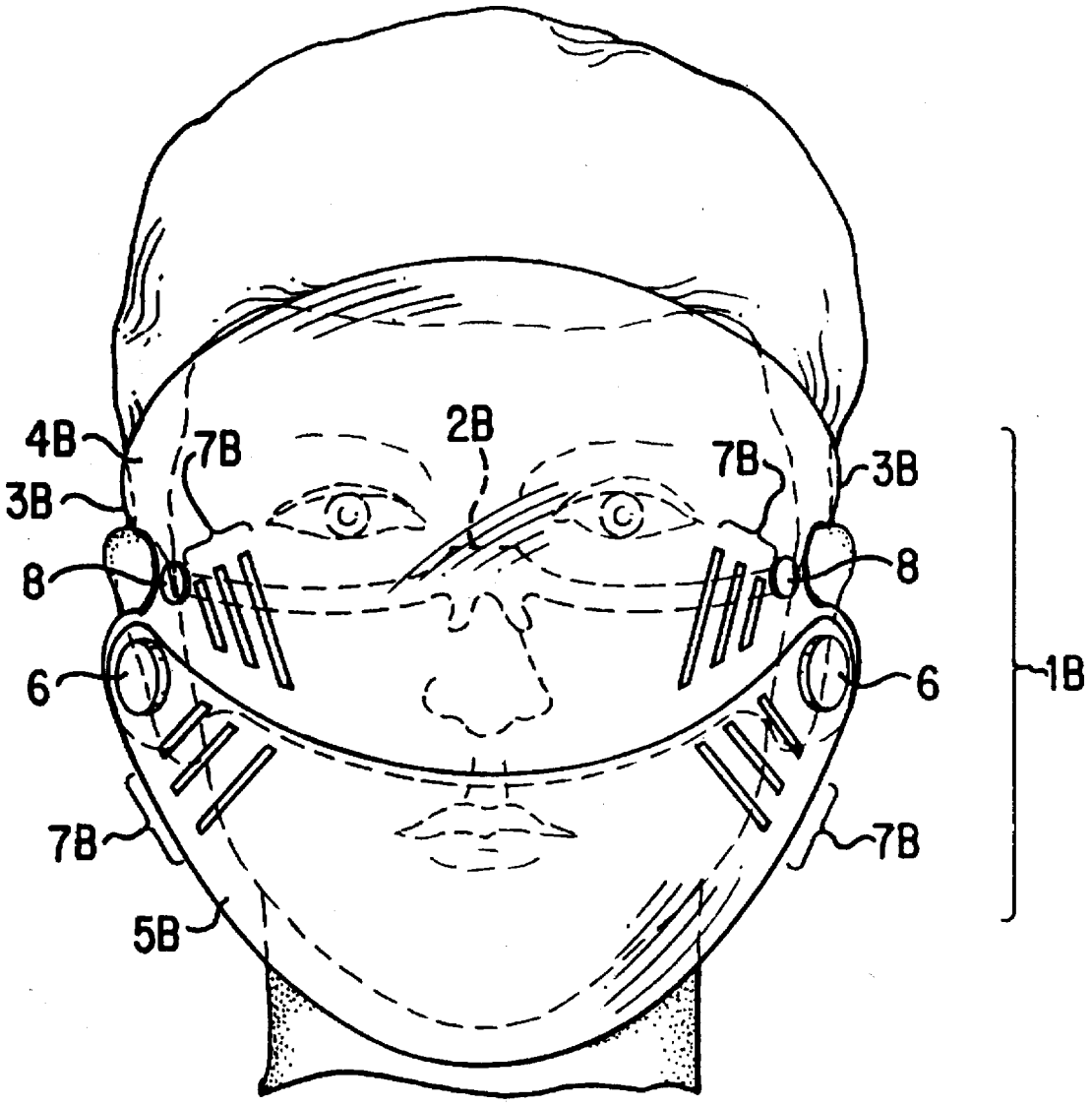
FIG. 7 is a frontal view of the collapsible sunmask of FIG. 5.

FIG. 7 shows a front view of the sunmask of FIG. 5.

Figure 8:
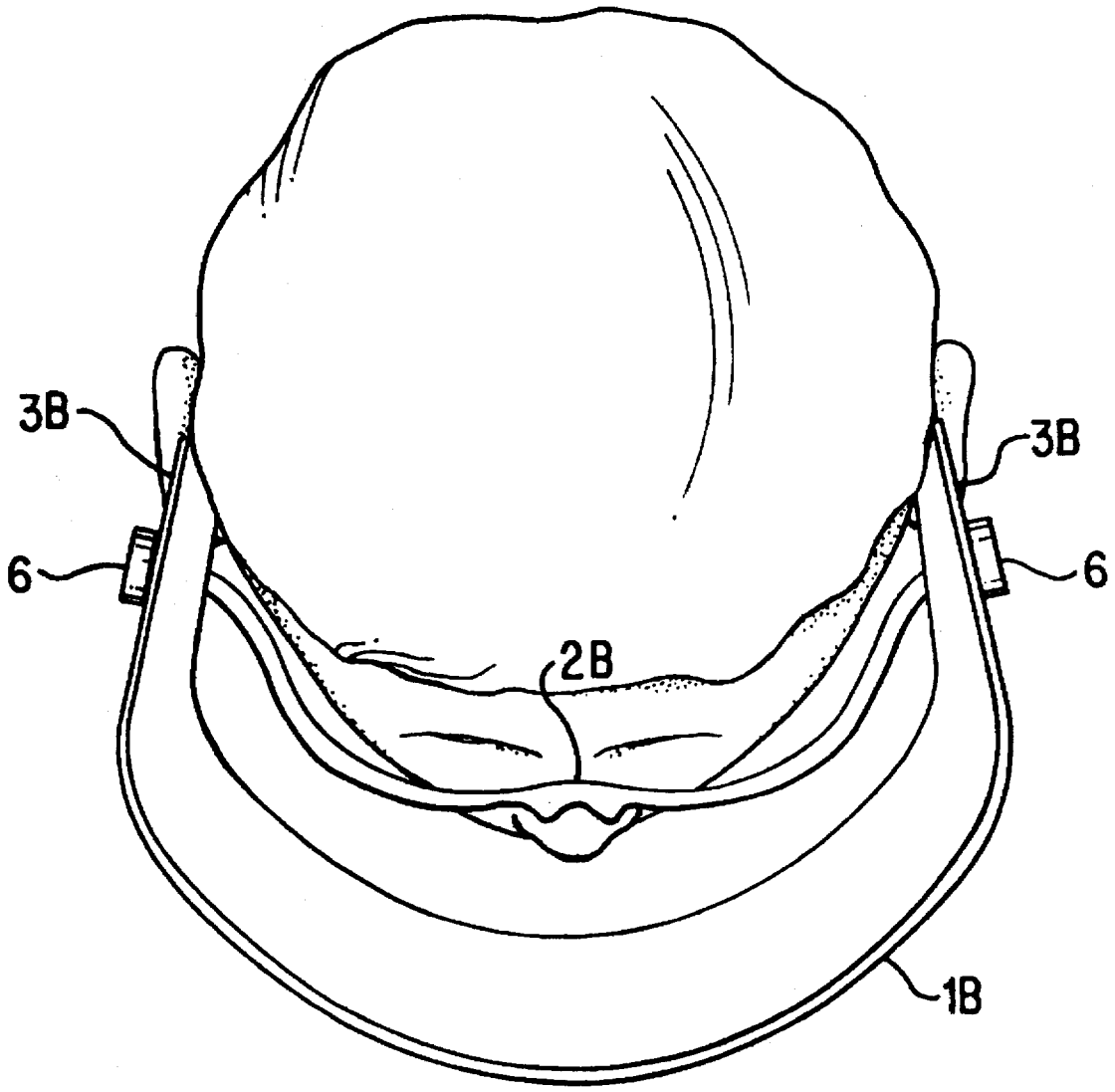
FIG. 8 is a top view of the collapsible sunmask of FIG. 5.

FIG. 8 shows a top view of the sunmask of FIG. 5.

FIGS. 9–12 depict a collapsible sunmask having a segmented shield (1C) and having a support means (2C) which rests upon the bridge of the nose of the wearer and an anchoring element (3C) which is continuous with the shield and which rests above the wearer's ears. The shield is comprised of two segments, a top panel (4C) and a lower panel (5C), joined at a rotation axis pivot (6). The shield is vented by multiple slit-like perforations (7C).

Figure 9:
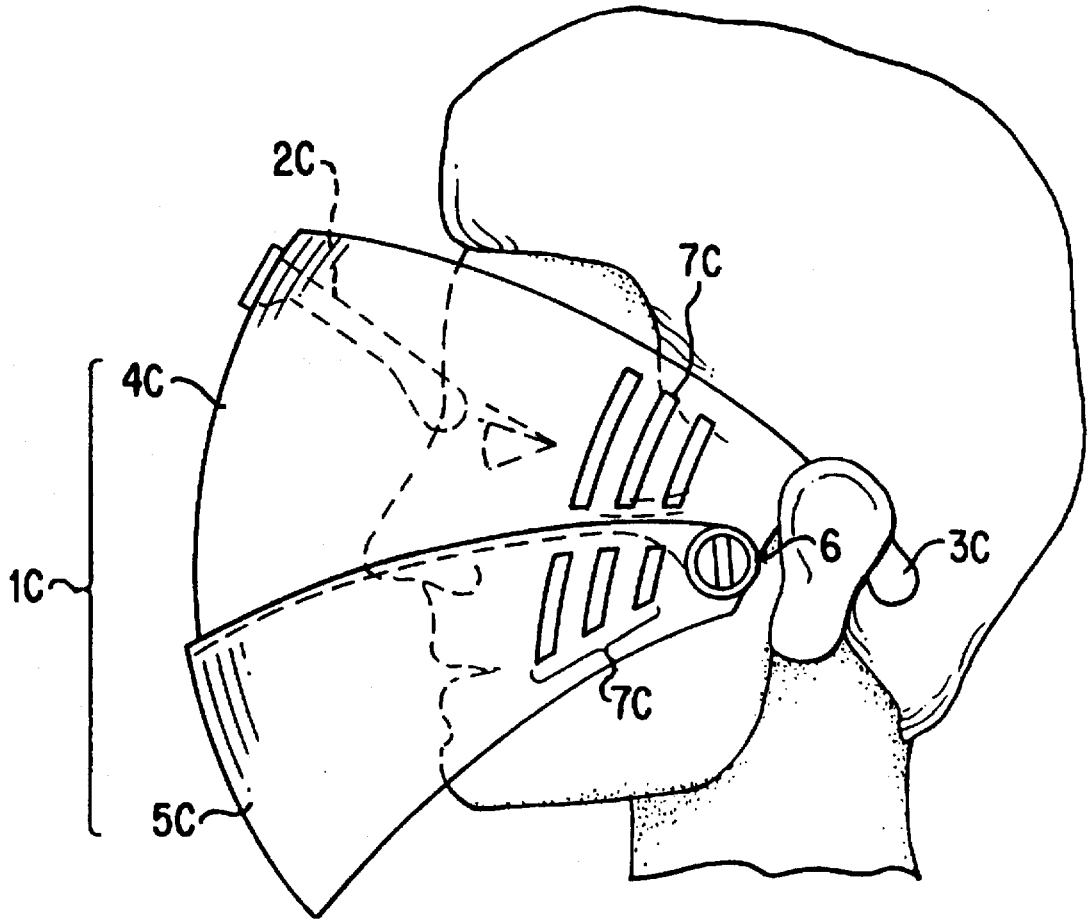
FIG. 9 is a side view of a collapsible sunmask having a shield in two segments, a top panel and a bottom panel, and having a support means which rests upon the bridge of the nose of the wearer.

FIG. 9 shows a side view of a collapsible sunmask having a segmented shield (1C), with the lower panel (5C) of the shield in down position. The support means (2C) engages the bridge of the nose of the wearer and maintains the shield at a proper distance overlying the wearer's face, thereby allowing free circulation of air.

Figure 10:
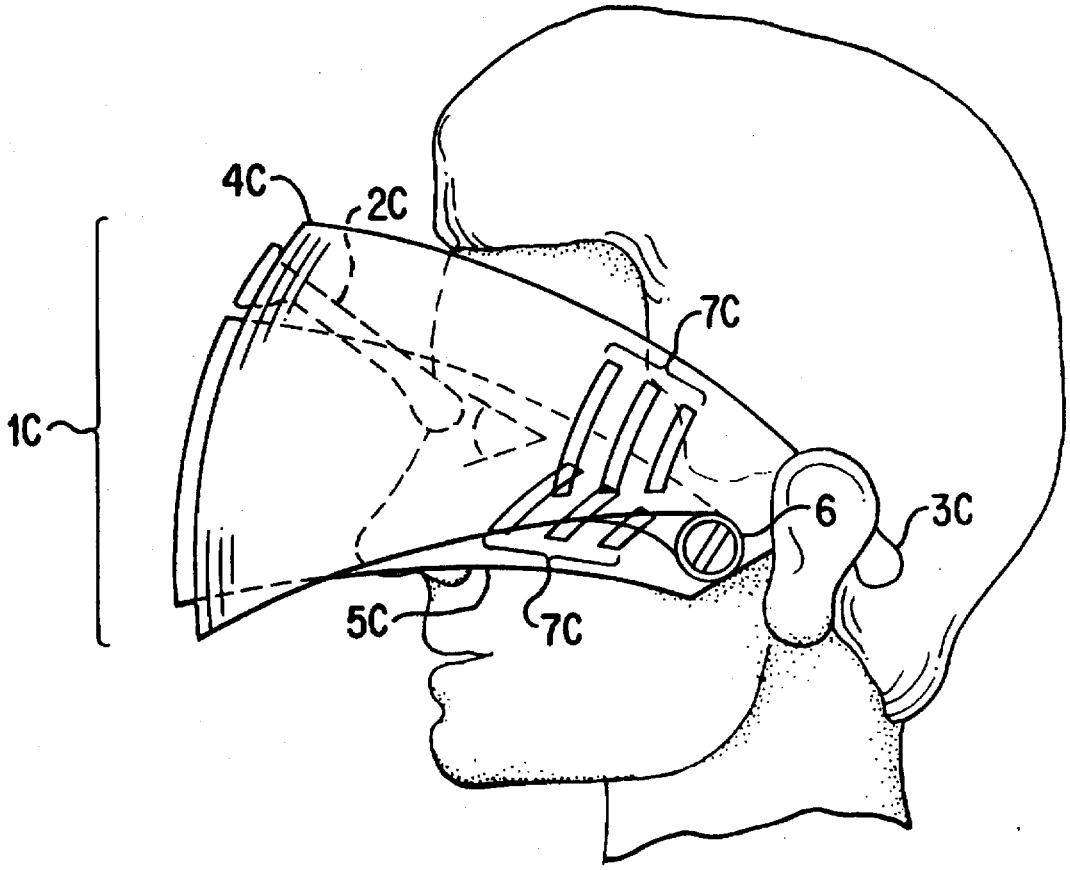
FIG. 10 is the collapsible sunmask of FIG. 9 with the lower panel rotated upward to produce a collapsed conformation.

FIG. 10 shows a side view of the sunmask of FIG. 9, with the lower panel (5C) of the shield in the up position to cover a portion of the upper panel (4C).

Figure 11:
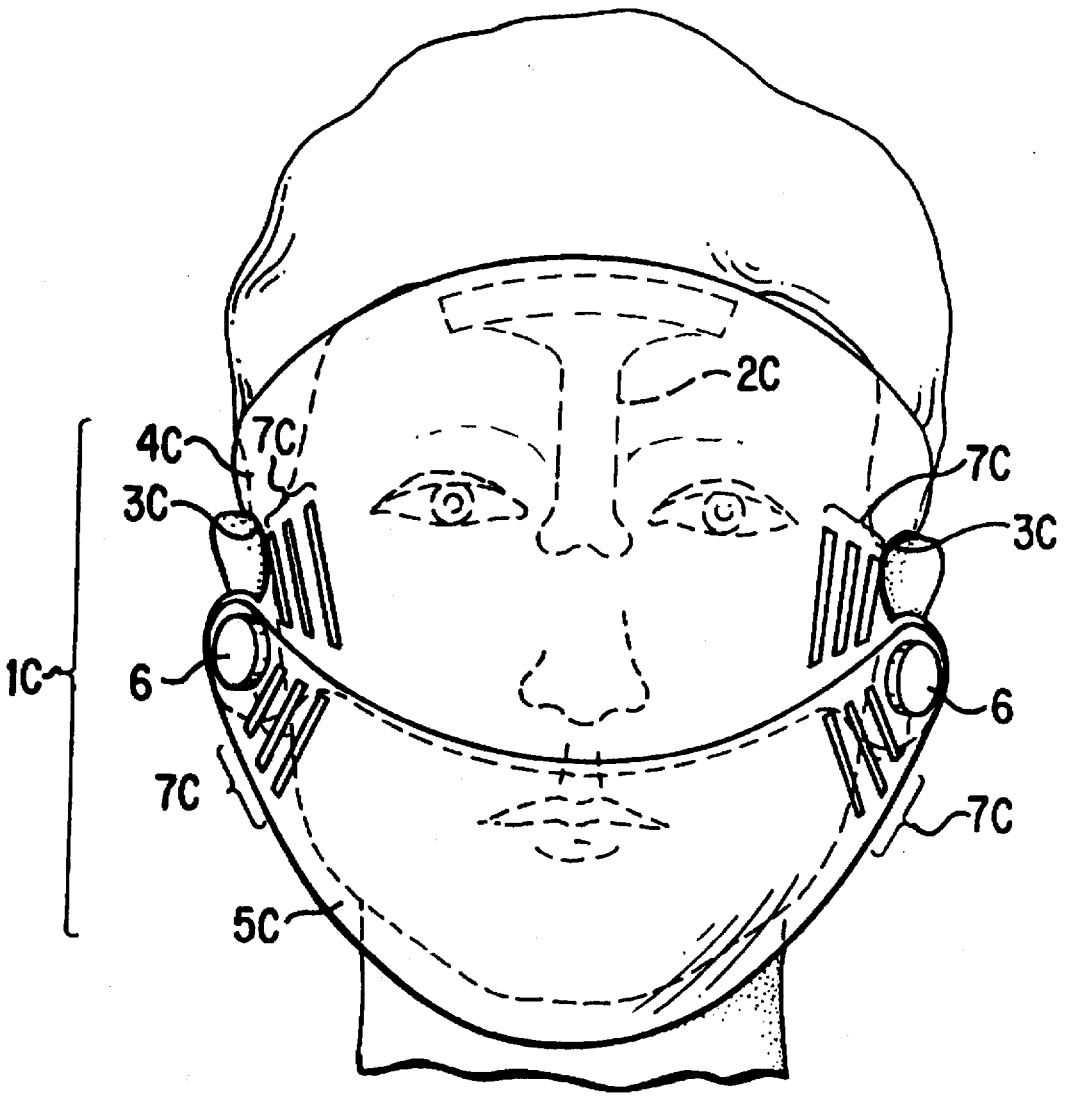
FIG. 11 is a frontal view of the collapsible sunmask of FIG. 9.

FIG. 11 shows a front view of the sunmask of FIG. 9, which shows that the support means (2C) is attached to the upper panel of the top panel (4C) of the shield over a wider area than that which engages the bridge of the nose of the wearer, thereby improving stability.

Figure 12:
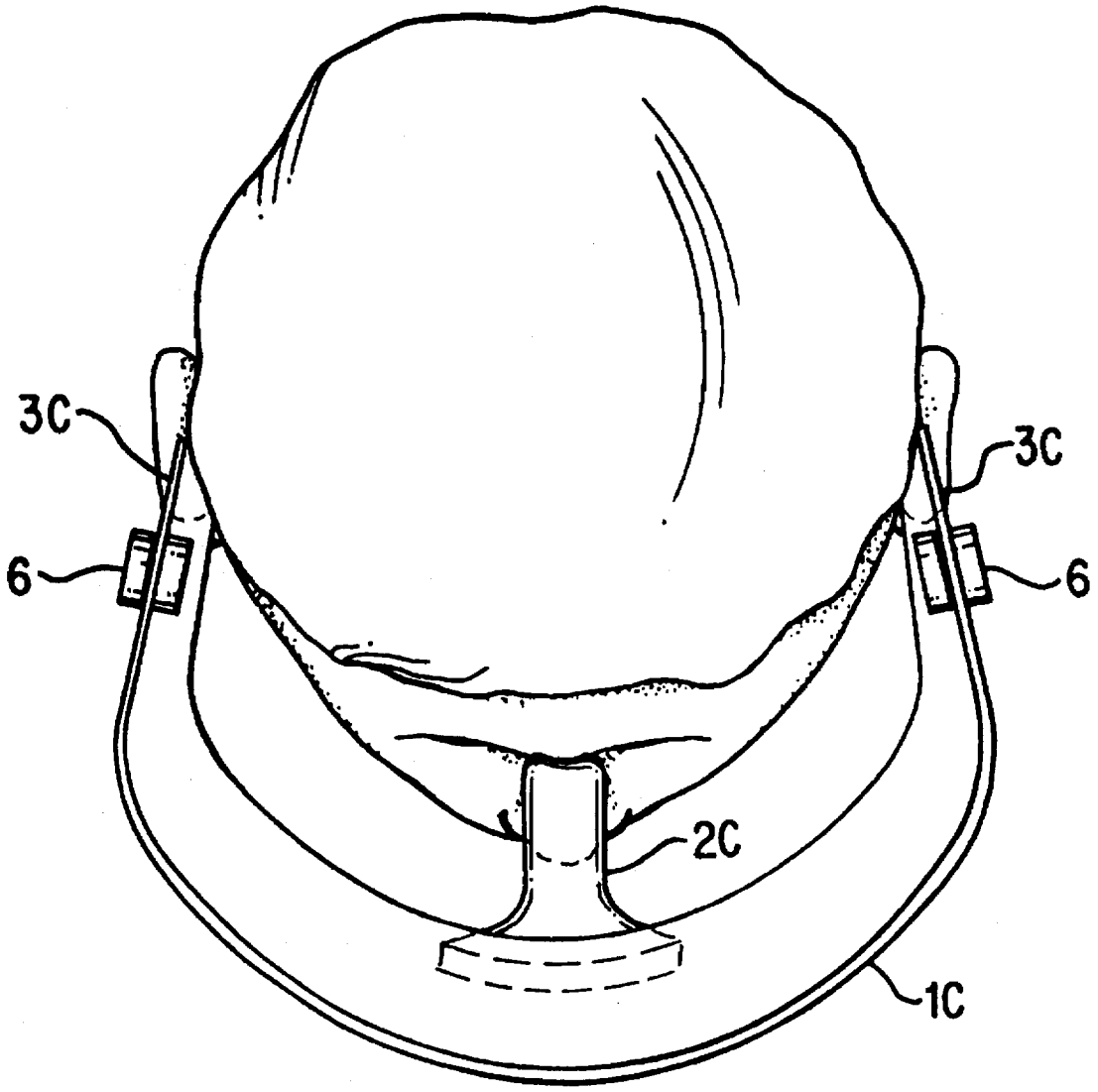
FIG. 12 is a top view of the collapsible sunmask of FIG. 9.

FIG. 12 shows a top view of the sunmask of FIG. 9.

Figure 13:
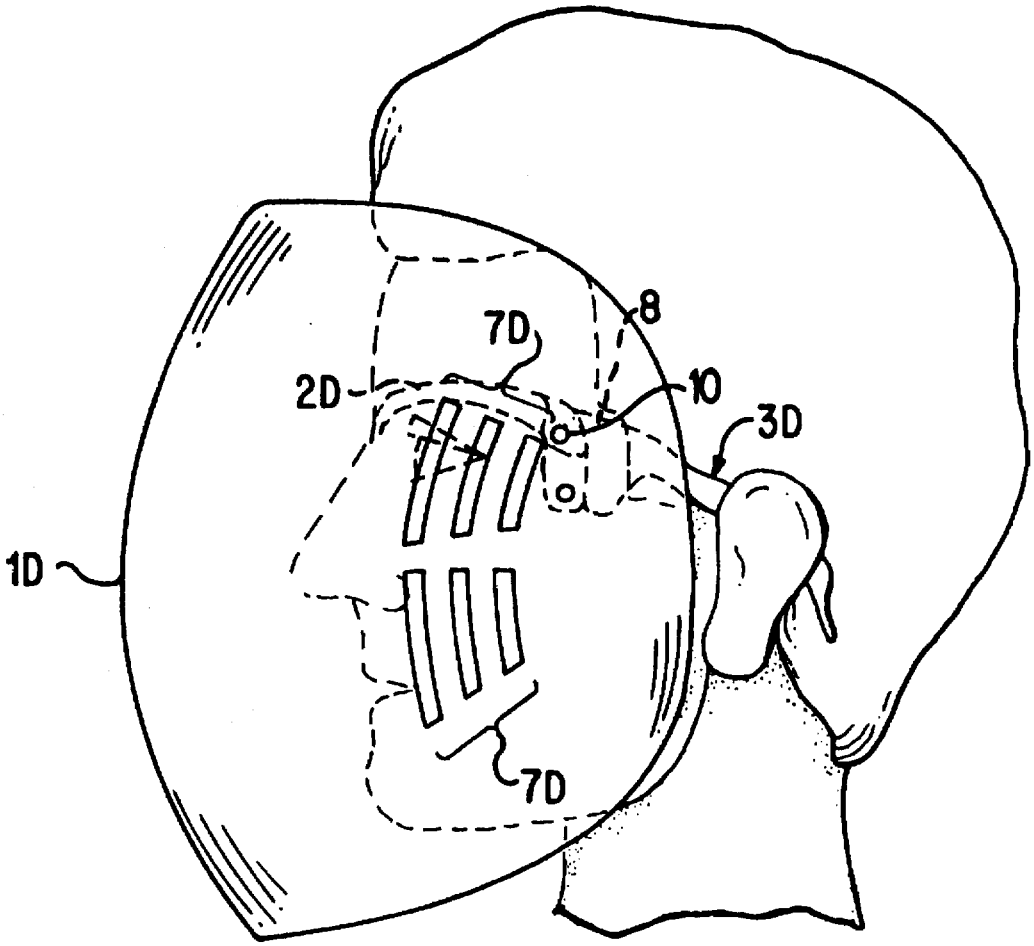
FIG. 13 is a side view of a non-collapsible sunmask having a support means which rests upon the bridge of the nose and across the forehead of the wearer.
Figure 14:
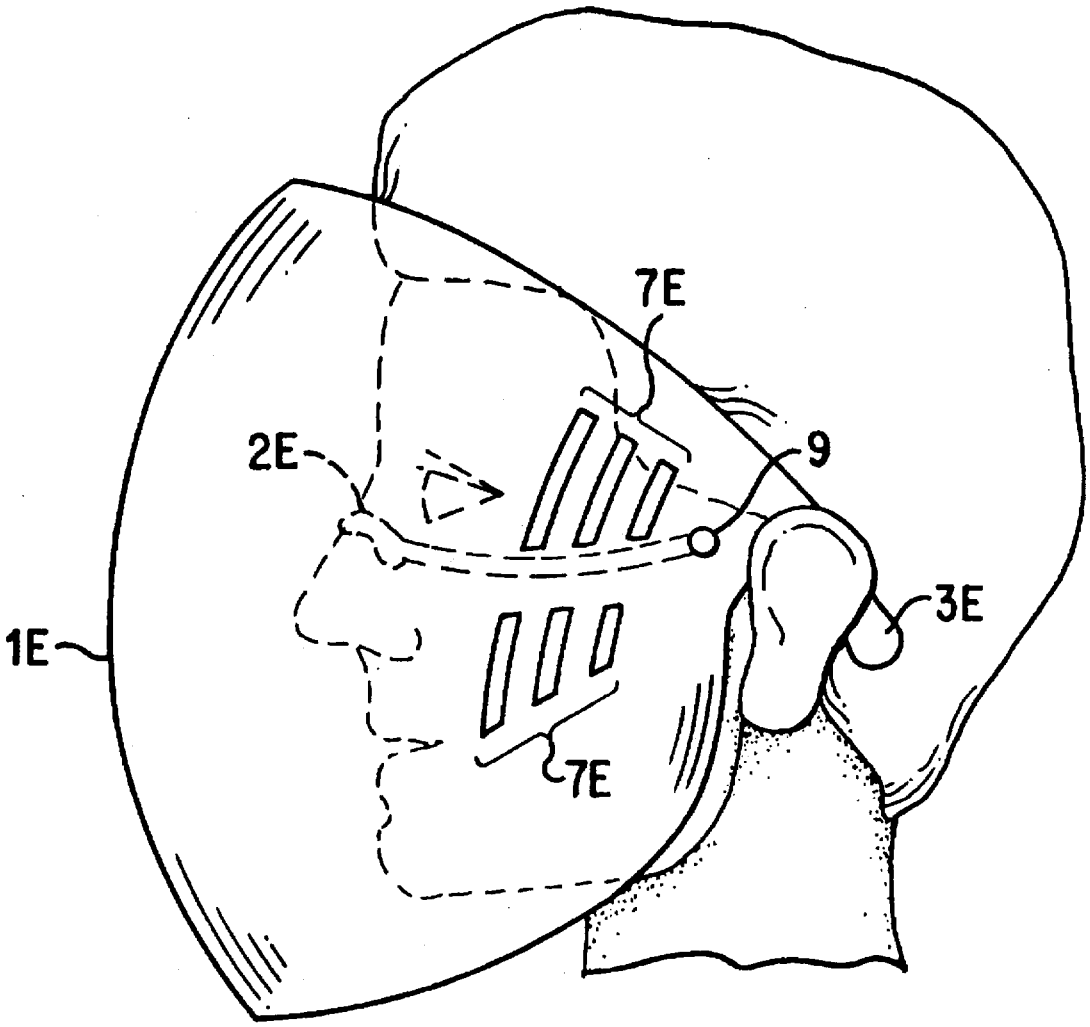
FIG. 14 is a side view of a non-collapsible sunmask having a support means which rests upon the bridge of the nose and across the cheeks of the wearer.
Figure 15:
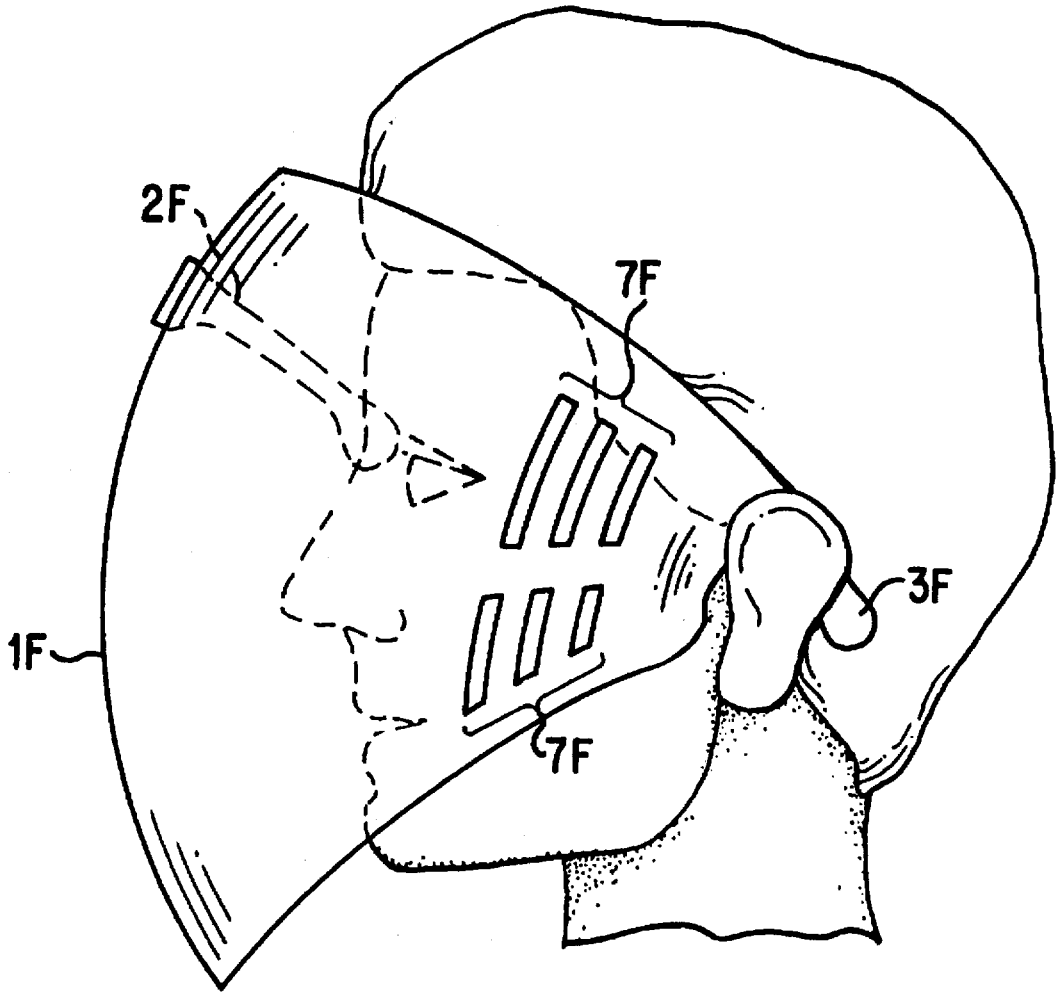
FIG. 15 is a side view of a non-collapsible sunmask having a support means which rests upon the bridge of the nose of the wearer.

FIGS. 13–15 depict noncollapsible sunmasks having unsegmented shields.

FIG. 13 shows a side view of a sunmask having an unsegmented shield (1D). The support means (2D) is attached to the shield at (10) and engages the bridge of the nose of the wearer and extends across the wearer's forehead, similar to the frontal piece of a conventional pair of eyeglasses. Ventilation slits (7D) are positioned at the sides of the shield to avoid the penetration of ultraviolet radiation onto the wearer's face. The anchoring means (3D) is connected (8) to the support means (2D) in a manner which resembles the joining of the frontal piece and the temple bars of conventional eyeglasses. The anchoring means (3D) engage the wearer's head above the ears.

FIG. 14 shows a side view of a sunmask having an unsegmented shield (1E). The support means (2E) engages the bridge of the nose of the wearer and extends across the cheeks of the wearer, and attaches to the shield at (9). Ventilation slits (7E) are positioned at the sides of the shield to avoid the penetration of ultraviolet radiation onto the wearer's face. The anchoring means (3E) engage the wearer's head above the ears.

FIG. 15 shows a side view of a sunmask having an unsegmented shield (1F). The support means (2F) engages the bridge of the nose of the wearer. Ventilation slits (7F) are positioned at the sides of the shield to avoid the penetration of ultraviolet radiation onto the wearer's face. The anchoring means (3F) engage the wearer's head above the ears.

From the foregoing, various other embodiments of the invention will be apparent to the skilled artisan.

What is claimed is:

1. A sunmask comprising (i) a curved shield that is fabricated from a material which blocks the penetration of ultraviolet radiation and is shaped and dimensioned to overlie the front and sides of the face of a wearer when the sunmask is worn, composed of a plurality of segments pivotally connected for movement about a pivot axis transverse to a wearer's head such that the segments may be moved between a position in which they overlie each other and overlie a only a portion of the wearer's face and a position in which they form a continuous shield which overlies the front and sides of the face of the wearer, (ii) support means that is attached to the shield and is adapted to engage at least one selected region of the wearer's face for positioning the shield in a predetermined position spaced apart from and overlying the wearer's face, and (iii) anchoring means that is attached to the shield and is adapted to engage the wearer's head in regions above the ears for holding the sunmask in place.

2. The sunmask of claim 1 wherein the support means engages the bridge of the nose and extends across the forehead of the wearer when worn.

3. The sunmask of claim 1 wherein the support means engages the bridge of the nose and extends across the cheeks of the wearer when worn.

4. The sunmask of claim 1 wherein the support means engages the bridge of the nose of the wearer.

5. The sunmask of claim 1 wherein the support means and anchoring means are interconnected.

6. The sunmask of claim 1 wherein the anchoring means is continuous with the shield.

7. The sunmask of claim 2 wherein the support means and anchoring means are interconnected.

8. The sunmask of claim 2 wherein the anchoring means is continuous with the shield.

9. The sunmask of claim 3 wherein the support means and anchoring means are interconnected.

10. The sunmask of claim 3 wherein the anchoring means is continuous with the shield.

11. The sunmask of claim 4 wherein the support means and anchoring means are interconnected.

12. The sunmask of claim 4 wherein the anchoring means is continuous with the shield.

* * * * *

UNITED STATES PATENT AND TRADEMARK OFFICE

CERTIFICATE OF CORRECTION

PATENT NO. : 5,682,606

DATED : November 4, 1997

INVENTOR(S) : Lisa Pospisil

It is certified that error appears in the above-identified patent and that said Letters Patent is hereby corrected as shown below:

Col. 4, line 10, "a only" should read --only--

Col. 6, line 22, "a only" should read --only--.

Signed and Sealed this

Ninth Day of June, 1998

*Attest:*

*Attesting Officer*

BRUCE LEHMAN

*Commissioner of Patents and Trademarks*